US009159278B2

(12) United States Patent
Huang

(10) Patent No.: US 9,159,278 B2
(45) Date of Patent: Oct. 13, 2015

(54) OVERDRIVE METHOD, APPARATUS, AND DISPLAY DEVICE

(71) Applicants: HISENSE HIVIEW TECH CO., LTD., Qingdao, Shandong (CN); HISENSE USA CORPORATION, Suwanee, GA (US)

(72) Inventor: Shunming Huang, Shandong (CN)

(73) Assignees: HISENSE HIVIEW TECH CO., LTD., Qingdao, Shandong (CN); HISENSE USA CORPORATION, Suwanee, GA (US)

( * ) Notice: Subject to any disclaimer, the term of this patent is extended or adjusted under 35 U.S.C. 154(b) by 89 days.

(21) Appl. No.: 14/149,087

(22) Filed: Jan. 7, 2014

(65) Prior Publication Data

US 2015/0070410 A1 Mar. 12, 2015

(30) Foreign Application Priority Data

Sep. 12, 2013 (CN) ..... 2013 1 0416656

(51) Int. Cl.
*G09G 3/36* (2006.01)
*G09G 3/10* (2006.01)
*G09G 5/18* (2006.01)

(52) U.S. Cl.
CPC ..... *G09G 3/3607* (2013.01); *G09G 3/3696* (2013.01); *G09G 5/18* (2013.01)

(58) Field of Classification Search
CPC ..... G09G 3/3607; G09G 3/3696; G09G 5/18; G09G 3/3648; G09G 2320/0252; G09G 2320/041; G09G 2340/16; G09G 2300/0452; G09G 2320/0242; G09G 2320/0693; G09G 2340/06
USPC ..... 345/30, 38, 39, 42, 50, 87, 204, 690, 345/208, 89, 94, 98–101
See application file for complete search history.

(56) References Cited

U.S. PATENT DOCUMENTS

2010/0134392 A1* 6/2010 Sumi ..... 345/87
2013/0010014 A1* 1/2013 Hasegawa et al. ..... 345/690

* cited by examiner

*Primary Examiner* — Kent Chang
*Assistant Examiner* — Nelson Rosario
(74) *Attorney, Agent, or Firm* — Tim Tingkang Xia, Esq.; Locke Lord LLP

(57) ABSTRACT

In one embodiment of the present invention, an overdrive (OD) method includes: acquiring a display grayscale value of a current frame within a display grayscale range; obtaining a target grayscale value of the current frame within a target grayscale range according to the display grayscale value of the current frame, where a minimum target grayscale value is larger than a minimum display grayscale value, and/or a maximum target grayscale value is smaller than a maximum display grayscale value, and each display grayscale value within the display grayscale range correspond one by one to one target grayscale value within the target grayscale range; and obtaining a system grayscale value of the current frame according to the target grayscale value of the current frame and a display grayscale value or a system grayscale value of a previous frame, and outputting a corresponding gamma voltage according to the system grayscale value.

23 Claims, 5 Drawing Sheets

| | Target grayscale value | | | | | | | |
|---|---|---|---|---|---|---|---|---|
| Display grayscale value | | 0 | 8 | 16 | ... | N | ... | 255 |
| | 0 | x(0, 0) | x(0, 8) | x(0, 16) | | x(0, N) | | x(0, 255) |
| | 8 | x(8, 0) | x(8, 8) | x(8, 16) | | x(8, N) | | x(8, 255) |
| | 16 | x(16, 0) | x(16, 8) | x(16, 16) | | x(16, N) | | x(16, 255) |
| | ... | | | | | | | |
| | N | x(N, 0) | x(N, 8) | x(N, 16) | | x(N, N) | | x(N, 255) |
| | ... | | | | | | | |
| | 255 | x(255, 0) | x(255, 8) | x(255, 16) | | x(255, N) | | x(255, 255) |

| Display grayscale value | Target grayscale value |
|---|---|
| 0 | P |
| 1 | 9 |
| 2 | 10 |
| ... | ... |
| 255 | R |

| | Grayscale value of current frame | | | | | | | |
|---|---|---|---|---|---|---|---|---|
| Grayscale value of previous frame | | 0 | 8 | 16 | ... | N | ... | 255 |
| | 0 | 0 | 10 | 20 | | | | 255 |
| | 8 | 0 | 8 | 18 | | | | 255 |
| | 16 | 0 | 6 | 16 | | | | 255 |
| | ... | 0 | | | | | | 255 |
| | N | 0 | | | | | | 255 |
| | ... | 0 | | | | | | 255 |
| | 255 | 0 | 0 | 1 | | | | 255 |
FIG. 3
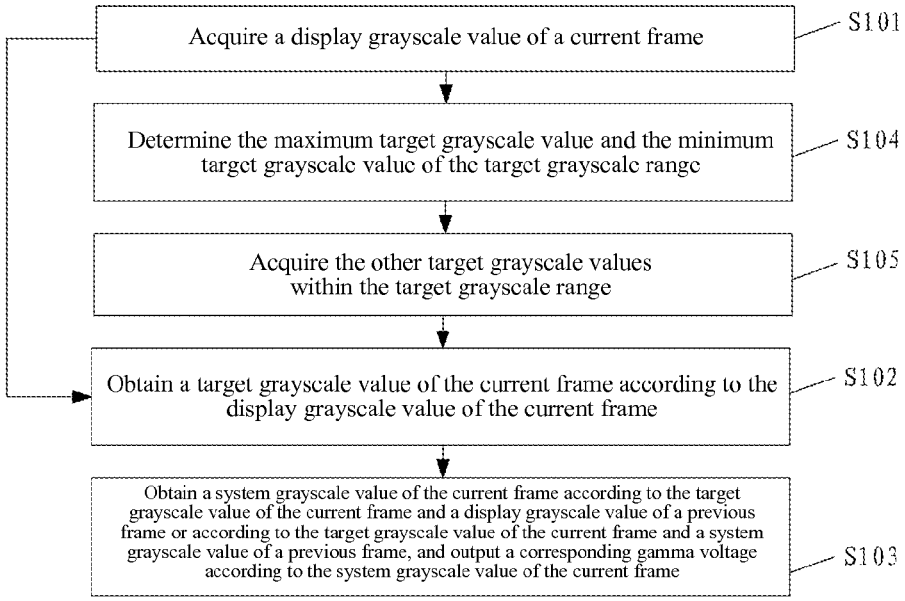
FIG. 4
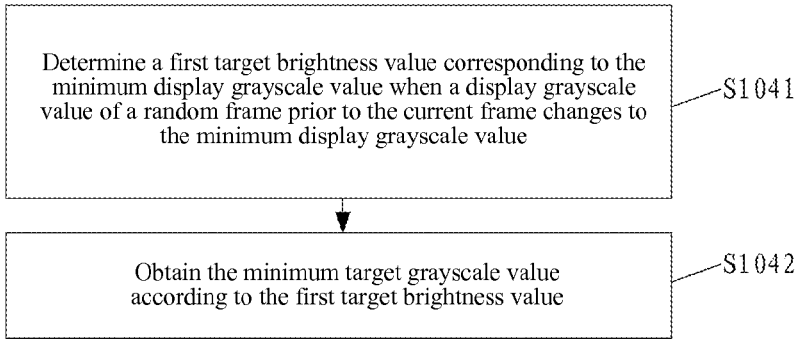
FIG. 5

| | Target grayscale value | | | | | | | |
|---|---|---|---|---|---|---|---|---|
| Display grayscale value | | 0 | 8 | 16 | ... | N | ... | 255 |
| | 0 | x(0, 0) | x(0, 8) | x(0, 16) | | x(0, N) | | x(0, 255) |
| | 8 | x(8, 0) | x(8, 8) | x(8, 16) | | x(8, N) | | x(8, 255) |
| | 16 | x(16, 0) | x(16, 8) | x(16, 16) | | x(16, N) | | x(16, 255) |
| | ... | | | | | | | |
| | N | x(N, 0) | x(N, 8) | x(N, 16) | | x(N, N) | | x(N, 255) |
| | ... | | | | | | | |
| | 255 | x(255, 0) | x(255, 8) | x(255, 16) | | x(255, N) | | x(255, 255) |
FIG. 6
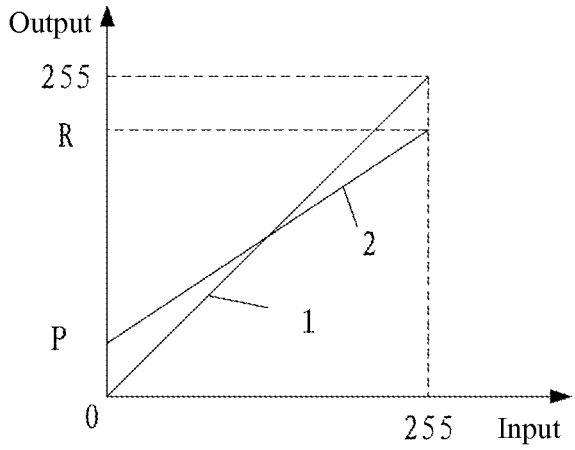
FIG. 7
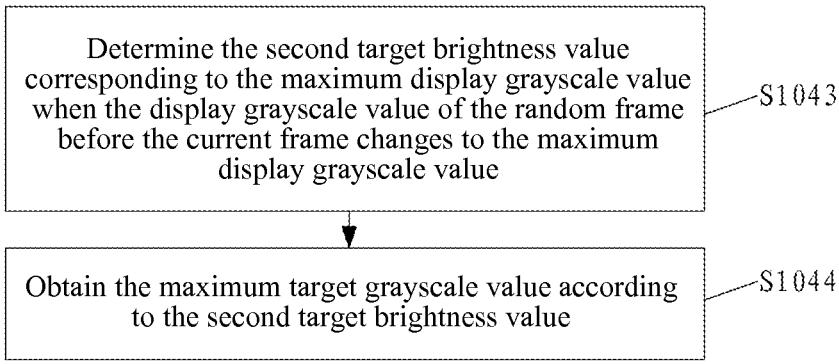
FIG. 8

OVERDRIVE METHOD, APPARATUS, AND DISPLAY DEVICE

CROSS-REFERENCE TO RELATED APPLICATION

This application claims the priority to Chinese Patent Application No. 201310416656.7, filed on Sep. 12, 2013, in the State Intellectual Property Office of China, which is hereby incorporated herein in its entirety by reference.

FIELD OF THE INVENTION

The present invention relates generally to display technology, and particularly to an overdrive method and apparatus, and a display device using the same.

BACKGROUND OF THE INVENTION

Compared with an ordinary two-dimensional display, a three-dimensional (3D) display makes pictures more stereoscopic and lifelike. An image is no longer constrained on a plane of a screen and looks as if coming out from the screen, giving a viewer the perception of being in the real world. The 3D display has gained attention in the field.

There are two types of 3D displays: a glasses-type 3D display and a naked-eye 3D display. Due to limitations on the space and technology for products, the naked-eye 3D display has not found wide application. The glasses-type 3D display becomes the mainstream 3D display technology currently because of advantages such as low technical requirements and simple implementation.

A shutter glasses-type 3D display technology uses a pair of active liquid crystal display (LCD) alternating shutter glasses, which enables a user to see a left image with the left eye at certain time and see a right image with the right eye at certain time. The brain of the user then combines the two images into one, thus achieving 3D display. When a display device that works with the alternating shutter glasses is a LCD, the frame frequency of the alternating shutter glasses needs to increase from conventional 60 hertz to 120 hertz or above to achieve 3D display. When liquid crystals of the LCD are driven in a common driving manner, crosstalk occurs in the shutter glasses-type 3D display due to problems such as the response time of the liquid crystals, which affects a visual effect.

To solve the foregoing problem, conventional technology adopts an overdrive (OD) method to shorten the response time of the liquid crystals to further reduce 3D crosstalk. Specifically, the transitional speed and twist angle of liquid crystal molecules are determined by the voltage applied. Thus, by increasing the voltage applied, the response time of the liquid crystal becomes shorter, which further mitigate the crosstalk problem. However, in a case where a pixel unit displays relatively white color (for example, a grayscale value larger than 248) and relatively black color (for example, a grayscale value smaller than 8), the effect of increasing of voltage to the response time of a liquid crystal is insignificant, and the brightness does not change much. In other words, when a grayscale value is relatively large or relatively small, an OD effect cannot be significantly achieved such that crosstalk of pictures cannot be mitigated, which affects a display effect.

Therefore, a heretofore unaddressed need exists in the art to address the aforementioned deficiencies and inadequacies.

SUMMARY OF THE INVENTION

Aspects of the present invention provide an OD method, apparatus, and display device. The OD method can effectively shorten a response time of the liquid crystals in a case where a grayscale value is large or a grayscale value is small, so as to further mitigate crosstalk and enhance a display effect.

One aspect of the present invention provides an OD method, which includes the step of acquiring a display grayscale value of a current frame, where the display grayscale value is a grayscale value within a display grayscale range.

The OD method also includes the step of obtaining a target grayscale value of the current frame according to the display grayscale value of the current frame, where the target grayscale value is a grayscale value within a target grayscale range, where a minimum target grayscale value of the target grayscale range is larger than a minimum display grayscale value of the display grayscale range, and/or a maximum target grayscale value of the target grayscale range is smaller than a maximum display grayscale value of the display grayscale range, and each of the display grayscale values within the display grayscale range corresponds one-by-one to one of the target grayscale values within the target grayscale range.

Further, the OD method includes the step of obtaining a system grayscale value of the current frame according to the target grayscale value of the current frame and a display grayscale value of a previous frame or according to the target grayscale value of the current frame and a system grayscale value of the previous frame, and outputting a corresponding gamma voltage according to the system grayscale value of the current frame.

In one embodiment, prior to the step of obtaining a target grayscale value of the current frame according to the display grayscale value of the current frame, the method further includes the steps of determining the maximum target grayscale value and the minimum target grayscale value of the target grayscale range according to the maximum display grayscale value and the minimum display grayscale value of the display grayscale range; and acquiring the other target grayscale values within the target grayscale range according to the maximum target grayscale value and the minimum target grayscale value of the target grayscale range and a corresponding relationship between the display grayscale value and the target grayscale value.

In one embodiment, the corresponding relationship between the display grayscale value and the target grayscale value is $$B = \frac{A * (R - P)}{255} + p,$$

where A is the display grayscale value of the current frame, B is the target grayscale value of the current frame, R is the maximum target grayscale value, and P is the minimum target grayscale value.

In one embodiment, the step of determining the maximum target grayscale value and the minimum target grayscale value of the target grayscale range according to the maximum display grayscale value and the minimum display grayscale value of the display grayscale range includes the steps of determining a first target brightness value corresponding to the minimum display grayscale value when a display grayscale value of a random frame prior to the current frame changes to the minimum display grayscale value; obtaining the minimum target grayscale value according to the first target brightness value; determining a second target brightness value corresponding to the maximum display grayscale value when a display grayscale value of the random frame prior to the current frame changes to the maximum display grayscale value; and obtaining the maximum target grayscale value according to the second target brightness value.

In one embodiment, the first target brightness value is a maximum brightness value corresponding to the minimum display grayscale value.

In one embodiment, the second target brightness value is a minimum brightness value corresponding to the maximum display grayscale value.

In one embodiment, the random frame prior to the current frame is the previous frame of the current frame.

In one embodiment, the step of obtaining the minimum target grayscale value according to the first target brightness value includes: obtaining the minimum target grayscale value by searching a mapping table according to the display grayscale value of the random frame prior to the current frame and the first target brightness value.

In one embodiment, the step of obtaining the maximum target grayscale value according to the first target brightness value includes: obtaining the maximum target grayscale value by searching a mapping table according to the display grayscale value of the random frame prior to the current frame and the second target brightness value.

In one embodiment, the step of obtaining a target grayscale value of the current frame according to the display grayscale value of the current frame includes: obtaining the target grayscale value of the current frame through linear compensation or through mapping compensation with a first lookup table according to the display grayscale value of the current frame.

In one embodiment, the step of obtaining a system grayscale value of the current frame according to the target grayscale value of the current frame and a display grayscale value of a previous frame or according to the target grayscale value of the current frame and a system grayscale value of a previous frame includes: obtaining the system grayscale value of the current frame by querying a second lookup table according to the target grayscale value of the current frame and the display grayscale value of the previous frame or according to the target grayscale value of the current frame and the system grayscale value of the previous frame.

In one embodiment, the minimum target grayscale value is 8, and the maximum target grayscale value is 248.

In a further aspect, embodiments of the present invention provide an OD apparatus, which includes a display grayscale value acquisition unit, a target grayscale value acquisition unit and an output unit.

The display grayscale value acquisition unit is configured to acquire a display grayscale value of a current frame, where the display grayscale value is a grayscale value within a display grayscale range.

The target grayscale value acquisition unit is configured to obtain a target grayscale value of the current frame according to the display grayscale value of the current frame acquired by the display grayscale value acquisition unit, where the target grayscale value is a grayscale value within a target grayscale range, where a minimum target grayscale value of the target grayscale range is larger than a minimum display grayscale value of the display grayscale range, and/or a maximum target grayscale value of the target grayscale range is smaller than a maximum display grayscale value of the display grayscale range, and each of the display grayscale values within the display grayscale range corresponds one-by-one to one of the target grayscale values within the target grayscale range.

The output unit is configured to obtain a system grayscale value of the current frame according to the target grayscale value of the current frame obtained by the target grayscale value acquisition unit and a display grayscale value of a previous frame or according to the target grayscale value of the current frame obtained by the target grayscale value acquisition unit and a system grayscale value of a previous frame, and to output a corresponding gamma voltage according to the system grayscale value of the current frame.

In one embodiment, the apparatus further includes a target grayscale range acquisition unit, which includes a determination module and an acquisition module.

The determination module is configured to determine the maximum target grayscale value and the minimum target grayscale value of the target grayscale range according to the maximum display grayscale value and the minimum display grayscale value of the display grayscale range.

The acquisition module is configured to acquire the other target grayscale values within the target grayscale range according to the maximum target grayscale value and the minimum target grayscale value of the target grayscale range and a corresponding relationship between the display grayscale value and the target grayscale value.

In one embodiment, the determination module includes a target value acquisition submodule, configured to determine a first target brightness value corresponding to the minimum display grayscale value when a display grayscale value of a random frame prior to the current frame changes to the minimum display grayscale value; and a processing submodule, configured to obtain the minimum target grayscale value according to the first target brightness value.

In one embodiment, the target value acquisition submodule is further configured to determine a second target brightness value corresponding to the maximum display grayscale value when a display grayscale value of a random frame prior to the current frame changes to the maximum display grayscale value; and the processing submodule is further configured to obtain the maximum target grayscale value according to the second target brightness value.

In one embodiment, the processing submodule is configured to obtain the minimum target grayscale value by searching a mapping table according to the display grayscale value of the random frame prior to the current frame and the first target brightness value, and to obtain the maximum target grayscale value by searching the mapping table according to the display grayscale value of the random frame prior to the current frame and the second target brightness value.

In one embodiment, the target grayscale range acquisition unit is configured to obtain the target grayscale value of the current frame through linear compensation or through mapping compensation with a first lookup table according to the display grayscale value of the current frame acquired by the display grayscale value acquisition unit.

In one embodiment, the output unit is configured to obtain the system grayscale value of the current frame by querying a second lookup table according to the target grayscale value of the current frame obtained by the target grayscale value acquisition unit and the display grayscale value of the previous frame or according to the target grayscale value of the current frame obtained by the target grayscale value acquisition unit and the system grayscale value of the previous frame.

Another aspect of the present invention relates a display device, which includes the OD apparatus provided by any of the embodiments of the present invention.

According to the embodiments of the present invention, the OD method processes a display grayscale value to obtain a corresponding target grayscale value, where the target grayscale value is a grayscale value in a target grayscale range, the minimum target grayscale value of the target grayscale range is larger than the minimum display grayscale value of the display grayscale range, and/or the maximum target grayscale value of the target grayscale range is smaller than the maximum display grayscale value of the display grayscale range, and each display grayscale value in the display grayscale range correspond one by one to one target grayscale value in the target grayscale range, so as to perform overdriving for the maximum target grayscale value and/or the minimum target grayscale value of the target grayscale range, thereby effectively shortening a response time of the liquid crystals, so as to further mitigate crosstalk and enhance a display effect.

These and other aspects of the invention will become apparent from the following description of the preferred embodiment taken in conjunction with the following drawings, although variations and modifications therein may be effected without departing from the spirit and scope of the novel concepts of the invention.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment.

FIG. 3 is a schematic view of a second lookup table according to one embodiment of the present invention.

FIG. 4 is a schematic flow chart of another OD method according to one embodiment of the present invention.

FIG. 5 is a schematic flow chart of a method for acquiring the minimum target grayscale value according to one embodiment of the present invention.

FIG. 6 is a schematic view of a mapping table provided by an embodiment of the present invention.

FIG. 7 is a schematic view of a mapping relationship according to one embodiment of the present invention.

FIG. 8 is a schematic view of a method for acquiring the maximum target grayscale value according to one embodiment of the present invention.

DETAILED DESCRIPTION OF THE INVENTION

Figures 1, 2:
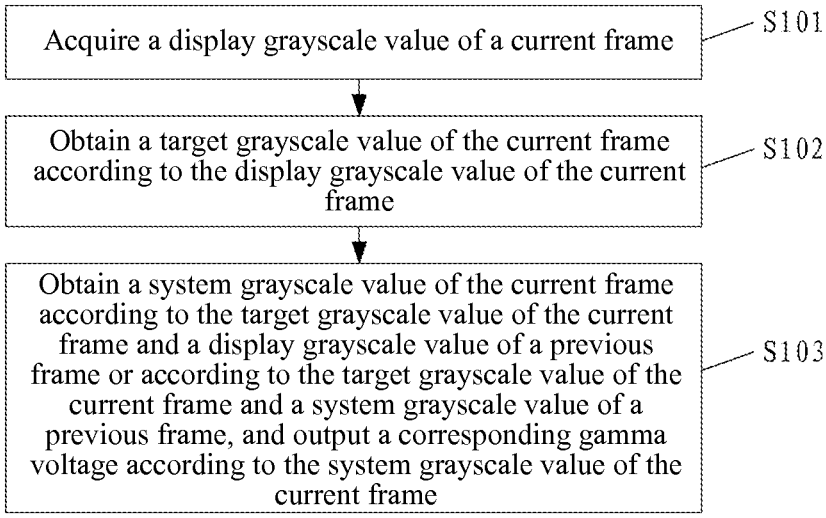
FIG. 1 is a schematic flow chart of an OD method according to one embodiment of the present invention.
FIG. 2 is a schematic view of a first lookup table according to one embodiment of the present invention.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are configured to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that, although the terms first, second, third etc. may be used herein to describe various elements, components, regions, layers and/or sections, these elements, components, regions, layers and/or sections should not be limited by these terms. These terms are only configured to distinguish one element, component, region, layer or section from another element, component, region, layer or section. Thus, a first element, component, region, layer or section discussed below could be termed a second element, component, region, layer or section without departing from the teachings of the disclosure.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", or "includes" and/or "including" or "has" and/or "having" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising," "including," "having," "containing," "involving," and the like are to be understood to be open-ended, i.e., to mean including but not limited to.

As used herein, the term "unit", "module" or "submodule" may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term unit, module or submodule may include memory (shared, dedicated, or group) that stores code executed by the processor.

The description will be made as to the embodiments of the invention in conjunction with the accompanying drawings in FIGS. 1-13. It should be understood that specific embodiments described herein are merely used for explaining the invention, but are not intended to limit the invention. In accordance with the purposes of this disclosure, as embodied and broadly described herein, this invention, in one aspect, relates to an overdrive (OD) method. In another aspect, the present invention relates to an OD apparatus. Additionally, the present invention further discloses a display device having the OD apparatus.

It should be noted that an existing display generally displays an image with grayscale values of 0-255. The embodiments of the present invention are illustrated in detail using an example that a display grayscale range is 0-255; that is, the display grayscale range includes 256 display grayscale values. In certain embodiments, a display may also display an image with a specified grayscale range or specified grayscale values. For example, a display may display an image with grayscale values having only the odd numbers of the grayscale values 0-255.

In an existing display device, to reduce a response time of the liquid crystals, a corresponding drive voltage may be increased. Specifically, in a case where a display grayscale value of a frame is 20 and a display grayscale value of an immediate next frame is 200, a voltage corresponding to a grayscale value of 220 may be output to a data line through driving an Integrated Circuit (IC) to shorten the response time of the liquid crystals. Such a process is called overdriving. Among the display grayscale values 0-255, the relatively white color is indicated by a large grayscale value, for example, a grayscale value larger than 248; alternately, the relatively black color is indicated by a small grayscale value, for example, a grayscale value smaller than 8. In both cases, an OD effect is not significant. To solve this problem, an embodiment of the present invention provides an OD method, in which a display grayscale value is first performed with "grayscale cutting," that is, excessively large grayscale values and/or excessively low grayscale values in a display grayscale range are removed to obtain another target grayscale range, where the display grayscale values in the display grayscale range correspond one by one to the target grayscale values in the target grayscale range. Then, overdriving is performed on the target grayscale values in the target range, so as to effectively shorten the response time of the liquid crystal.

An embodiment of the present invention provides an OD method, which, as shown in FIG. 1, includes:

Step 101: Acquire a display grayscale value of a current frame.

Specifically, the display grayscale value is a grayscale value in a display grayscale range. For example, the display grayscale range is 0-255, which includes 256 display grayscale values, and correspondingly every non-negative integer among 0-255 is a display grayscale value.

Step 102: Obtain a target grayscale value of the current frame according to the display grayscale value of the current frame.

Specifically, the target grayscale value is a grayscale value in a target grayscale range. The minimum target grayscale value of the target grayscale range is larger than the minimum display grayscale value of the display grayscale range, and/or the maximum target grayscale value of the target grayscale range is smaller than the maximum display grayscale value of the display grayscale range. Each of the display grayscale values in the display grayscale range corresponds one by one to one of the target grayscale values in the target grayscale range.

It should be noted that the display grayscale range may be the display grayscale values of a display device, and the target grayscale range is obtained by performing "grayscale cutting" on the existing display grayscale range. In certain embodiments of the present invention, the feature that the minimum target grayscale value of the target grayscale range is larger than the minimum display grayscale value of the display grayscale range, and/or the maximum target grayscale value of the target grayscale range is smaller than the maximum display grayscale value of the display grayscale range may specifically may be implemented by that: the minimum target grayscale value is larger than the minimum display grayscale value, and the maximum target grayscale value is larger than or equal to the maximum display grayscale value, so as to solve the problem that an OD effect is not significant when a display grayscale value is excessively small. Alternatively, in certain embodiments, the same feature may be implemented by that: the maximum target grayscale value is smaller than the maximum display grayscale value, and the minimum target grayscale value is smaller than or equal to the minimum display grayscale value, so as to solve the problem that an OD effect is not significant when a display grayscale value is excessively large. In certain embodiments, the same feature may be implemented by that: the minimum target grayscale value is larger than the minimum display grayscale value, and the maximum target grayscale value is smaller than the maximum display grayscale value. In other words, the target grayscale range is within the display grayscale range, so as to solve the problem that an OD effect is not significant when a display grayscale value is excessively large or excessively small. An embodiment of the present invention is hereinafter described in detail using the example that the minimum target grayscale value is larger than the minimum display grayscale value and the maximum target grayscale value is smaller than the maximum display grayscale value.

Each of the display grayscale values within the display grayscale range corresponds one by one to one of the target grayscale values within the target grayscale range. That is, the display grayscale range is 0-255 and includes 256 grayscale values, and therefore the target grayscale range includes 256 grayscale values, and one display grayscale value within the display grayscale range corresponds to one target grayscale value within the target grayscale range.

It should be noted that the target grayscale range and the target grayscale values within the target grayscale range may be obtained through calculation or may be pre-stored by a system. The maximum target grayscale value and the minimum target grayscale value of the target grayscale range may be calculated and thus are not fixed. The embodiment of the present invention is hereinafter described in detail using an example where, for the target grayscale range, the maximum target grayscale value is 248, and the minimum target grayscale value is 8.

Specifically, Step 102 of obtaining a target grayscale value of the current frame according to the display grayscale value of the current frame may be implemented specifically by:

obtaining the target grayscale value of the current frame through linear compensation or through mapping compensation with a first lookup table according to the display grayscale value of the current frame. In certain embodiments, the target grayscale value of the current frame may further be obtained in other compensation manners such as nonlinear compensation according to the display grayscale value of the current frame. The linear compensation may be compensation based on the linear relationship target between the grayscale value and the display grayscale value as well as the maximum target grayscale value and the minimum target grayscale value. An embodiment is hereinafter described in detail as follows using an example of the mapping compensation with a first lookup table.

In certain embodiments, in the mapping compensation with the first lookup table, a target grayscale value corresponding to a display grayscale value of a current frame may be directly obtained through the first lookup table. Specifically, in an example where a display grayscale value of a current frame is 2, the corresponding target grayscale value of the current frame is 10 through the first lookup table as shown in FIG. 2, where P is the minimum grayscale value of the mapped grayscale, i.e., the minimum target grayscale value, and R is the maximum grayscale value of the mapped grayscale, i.e., the maximum target grayscale value. It should be noted that FIG. 2 shows the first lookup table using an 8-bit mapping manner, which may certainly be replaced by a 10-bit or 12-bit mapping manner, and the like. The embodiment of the present invention is hereinafter described in detail only using an example of the 8-bit mapping manner.

Step 103: Obtain a system grayscale value of the current frame according to the target grayscale value of the current frame and the display grayscale value of the previous frame or according to the target grayscale value of the current frame and a system grayscale value of the previous frame, and output a corresponding gamma voltage according to the system grayscale value of the current frame.

It should be noted that, the system grayscale value is a compensated grayscale value after overvoltage compensation is performed on the display grayscale value. For example, a display grayscale value of a previous frame is 20, and a display grayscale value of a current frame is 200. To shorten a response time of the liquid crystals, a voltage corresponding to a grayscale value of 220 is output to a data line through driving an IC, and 220 is a system grayscale value of the current frame. Conventionally, a system grayscale value of a current frame is usually obtained through a display grayscale value of a current frame and a display grayscale value of a previous frame. In one embodiment of the present invention, after a display grayscale value is compensated, a target grayscale value corresponding to the display grayscale value is obtained. Through the target grayscale value of the current frame and the display grayscale value of the previous frame, a system grayscale value of the current frame is obtained. The system grayscale value of the current frame may further be obtained according to the target grayscale value of the current frame and a system grayscale value of the previous frame.

Specifically, an example is hereinafter described where a display grayscale value of a first frame is 200, a display grayscale value of a second frame is 20, a display grayscale value of a third frame is 20, and a display grayscale value of a current frame is 20. In other words, the display grayscale values are 200-20-20.

In a conventional example, overdriving is performed from the first frame to the second frame. According to the display grayscale value of the first frame, which is 200, and the display grayscale value of the second frame, which is 20, a system grayscale value of the second frame may be obtained as, for example, 10. As the display grayscale value of the second frame and the display grayscale value of the third frame are both 20, overvoltage processing is not processed from the second frame to the third frame. In other words, the system grayscale values obtained are 200-10-20-20. Such a processing method is suitable for the display of images with a low switching speed, but may fail to perform timely overdriving for images with a high switching speed, which therefore affects the display effect.

According to one embodiment of the present invention, overdriving is performed from the first frame to the second frame. A system grayscale value of the second frame may be obtained as 9 according to the display grayscale value of the second frame, which is 20, and a corresponding target grayscale value of the first frame of 195, which is obtained based on the display grayscale value of the first frame of 200. Overdriving is performed from the second frame to the third frame, and a system grayscale value of the third frame may be obtained as 24 according to the system grayscale value of the second frame, which is 9, and a corresponding target grayscale value of the third frame of 21, which is obtained based on the display grayscale value of the third frame of 20. Overdriving is performed from the third frame to the current frame, and a system grayscale value of the current frame may be obtained as 18 according to the system grayscale value of the third frame, which is 24, and the corresponding target grayscale value of the current frame of 21, which is obtained based on the display grayscale value of the current frame of 20. In other words, the system grayscale values obtained are 200-9-24-18. In this embodiment, the system grayscale value of the current frame is obtained by adopting the system grayscale value of the previous frame and the target grayscale value of the current frame. Thus, timely overdriving may be performed on pictures with a high switching speed, so as to mitigate crosstalk and enhance the display effect.

Specifically, step 103 of obtaining a system grayscale value of the current frame according to the target grayscale value of the current frame and the display grayscale value of the previous frame or according to the target grayscale value of the current frame and a system grayscale value of the previous frame may be implemented by:

obtaining the system grayscale value of the current frame by querying a second lookup table according to the target grayscale value of the current frame and the display grayscale value of the previous frame or according to the target grayscale value of the current frame and the system grayscale value of the previous frame.

Specifically, an example of the second lookup table is shown in FIG. 3. The second lookup table includes search axes in two directions, X and Y. The X direction is the grayscale value of a current frame, and the Y direction is the grayscale value of a previous frame. Through the grayscale value of the current frame in the X direction and the grayscale value of the previous frame in the Y direction, the corresponding system grayscale value can be obtained. Specifically, an alternative embodiment of obtaining the system grayscale value of the current frame according to the target grayscale value of the current frame and the system grayscale value of the previous frame is hereinafter described in detail. In this alternative embodiment, the X direction is the target grayscale value of the current frame, and the Y direction is the system grayscale value of the previous frame. A corresponding system grayscale value of the current frame is obtained according to the target grayscale value of the current frame in the X direction and the system grayscale value of the previous frame in the Y direction. Specifically, in an example where the target grayscale value of the current frame is 16 and the system grayscale value of the previous frame is 8, the system grayscale value of the current frame may be obtained as 18 according to X=16 and Y=8.

It should be noted that the second lookup table includes search axes in two directions, X and Y. When the system grayscale value of the current frame is obtained by querying the second lookup table according to the target grayscale value of the current frame and the display grayscale value of the previous frame, the "grayscale value of the previous frame" in the second lookup table refers to the display grayscale value of the previous frame, and the "grayscale value of the current frame" refers to the target grayscale value of the current frame.

In certain embodiments, prior to the step of obtaining a target grayscale value of the current frame according to the display grayscale value of the current frame, i.e., prior to Step 102, as shown in FIG. 4, the method further includes:

Step 104: Determine the maximum target grayscale value and the minimum target grayscale value of the target grayscale range according to the maximum display grayscale value and the minimum display grayscale value of the display grayscale range.

Specifically, as shown in FIG. 5, the step of determining the minimum target grayscale value of the target grayscale range according to the minimum display grayscale value of the display grayscale range, as described in Step 104, includes the following steps:

Step 1041: Determine a first target brightness value corresponding to the minimum display grayscale value when a display grayscale value of a random frame prior to the current frame changes to the minimum display grayscale value.

It should be noted that the first target brightness value may be a target brightness value corresponding to the minimum display grayscale value stored by the system when the display grayscale value of the random frame prior to the current frame changes to the minimum display grayscale value. In certain embodiments, the first target brightness value may be a target brightness value corresponding to the minimum display grayscale value when the display grayscale value of the previous frame of the current frame changes to the minimum display grayscale value. Therefore, the problem of failing to perform real-time update due to change of the brightness value by temperature and the like may be avoided. In certain embodiments, the first target brightness value may be the maximum brightness value corresponding to the minimum display grayscale value. In certain embodiments, the first target brightness value may also be preset. For example, the first target brightness value may be a value close to the maximum brightness value corresponding to the minimum display grayscale value. The embodiment of the present invention is described hereinafter in detail using the example that the first target brightness value is the maximum brightness value corresponding to the minimum display grayscale value.

Step 1042: Obtain the minimum target grayscale value according to the first target brightness value.

In certain embodiments, the minimum target grayscale value is obtained by searching a mapping table according to the display grayscale value of the random frame before the current frame and the target brightness value. Specifically, an example of the mapping table is shown in FIG. 6. The mapping table includes search axes in two directions, X and Y. The X direction is the target grayscale value, and the Y direction is the display grayscale value. Through the display grayscale value in the Y direction and the first target brightness value, i.e., X(N, N), the target grayscale value in the corresponding X direction may be obtained. For example, when the display grayscale value is 16 and the first target brightness value is X(16, 8), the target grayscale value may be obtained in the corresponding X direction as 8.

In certain embodiments, the target grayscale value can further be obtained directly in a graph, or may be calculated using a formula according to a corresponding relationship among a display grayscale value, a target brightness value, and a target grayscale value. Specifically, as shown in FIG. 7, line 1 is an existing display grayscale-brightness line, and line 2 is a corresponding target grayscale-brightness line according to one embodiment of the present invention. The brightness value corresponding to the display grayscale value may be obtained by inputting the display grayscale value of the random frame prior to the current frame with the display grayscale-brightness line 1, and then the corresponding target grayscale value may be further obtained as the output using the obtained brightness value with the target grayscale-brightness line 2. Specifically, as shown in FIG. 7, when the display grayscale value is 255, the value 255 may be correspondingly input in the input axis to obtain the maximum brightness value corresponding to the display grayscale value based on the display grayscale-brightness line 1. Then, the maximum brightness value obtained with the display grayscale-brightness line 1 is mapped vertically to the target grayscale-brightness line 2 as the brightness corresponding to the target grayscale value, and then mapped to horizontally to the output axis to obtain the target grayscale value R corresponding to the display grayscale value 255.

As shown in FIG. 8, the step of determining the maximum target grayscale value of the target grayscale range according to the maximum display grayscale value of the display grayscale range, as described in Step 104, includes the following steps:

Step 1043: Determine the second target brightness value corresponding to the maximum display grayscale value when the display grayscale value of the random frame prior to the current frame changes to the maximum display grayscale value.

It should be noted that the second target brightness value may be a target brightness value corresponding to the maximum display grayscale value stored by the system when the display grayscale value of the random frame prior to the current frame changes to the maximum display grayscale value. In certain embodiments, the second target brightness value may be a target brightness value corresponding to the maximum display grayscale value when the display grayscale value of the previous frame of the current frame changes to the maximum display grayscale value. Therefore, the problem of failing to perform real-time update due to change of the brightness value by temperature and the like may be avoided. In certain embodiments, the second target brightness value is the minimum brightness value corresponding to the maximum display grayscale value. In certain embodiments, the second target brightness value may also be preset. For example, the second target brightness value may be a value close to the minimum brightness value corresponding to the maximum display grayscale value. The embodiment of the present invention is described hereinafter in detail using the example that the second target brightness value is the minimum brightness value corresponding to the maximum display grayscale value.

Step 1044: Obtain the maximum target grayscale value according to the second target brightness value.

In certain embodiments, the maximum target grayscale value is obtained by searching a mapping table according to the display grayscale value of the random frame before the current frame and the target brightness value. Specifically, the step of obtaining the maximum target grayscale value by searching a mapping table according to the display grayscale value of the random frame prior to the current frame and the second target brightness value may be implemented by the same mapping method of obtaining the minimum target grayscale value according to the display grayscale value of the random frame prior to the current frame and the first target brightness value as described in Step 1042, and is thus not repeated here.

Step 105: Acquire the other target grayscale values within the target grayscale range according to the maximum target grayscale value and the minimum target grayscale value of the target grayscale range and a corresponding relationship between a display grayscale value and a target grayscale value.

Specifically, the minimum target grayscale value of the target grayscale range is larger than the minimum display grayscale value of the display grayscale range, and the maximum target grayscale value of the target grayscale range is smaller than the maximum display grayscale value of the display grayscale range. To ensure that the display grayscale values correspond one by one to the target grayscale values, the other target grayscale values of the target grayscale range are acquired according to the number of grayscale values contained in the display grayscale range. In other words, the target grayscale values within the target grayscale range other than the maximum target grayscale value and the minimum target grayscale value are acquired. Therefore, the target grayscale value may be obtained using a lookup table based on the corresponding display grayscale value.

In certain embodiments, the corresponding relationship between the display grayscale value and the target grayscale value may specifically be a linear compensation relationship of $$B = \frac{A * (R - P)}{255} + p,$$

where A is the display grayscale value of the current frame, B is the target grayscale value of the current frame, R is the maximum target grayscale value, and P is the minimum target grayscale value. Specifically, an example of the corresponding relationship for the target grayscale range may be described in detail, where the maximum target grayscale value is 248 and the minimum target grayscale value is 8. When a display grayscale value of a current frame is 100, the target grayscale value may be obtained as $$B = \frac{100 * (248 - 8)}{255} + 8$$

according to the foregoing linear compensation relationship as described in the formula. In other words, the target grayscale value B is 102. It should be noted that, in certain embodiments, the step of obtaining the target grayscale value through the display grayscale value is specifically implemented through binary calculation followed by conversion into the decimal system, and therefore the decimal digits of the target grayscale value may only include one of the four values of 0.00, 0.25, 0.50, and 0.75, which is obtained through rounding. In certain embodiments, the linear compensation relationship can be further used to directly obtain all of the target grayscale values according to the display grayscale values. In other words, through the foregoing linear compensation relationship, 254 target grayscale values within the target grayscale range (the other target grayscale values within the target grayscale range) may be obtained to form the target grayscale values within the target grayscale range excluding the maximum target grayscale value and the minimum target grayscale value.

It should be noted that, prior to the step of obtaining a target grayscale value of the current frame according to the display grayscale value of the current frame, Step 104 and Step 105 may be further included. In certain embodiments, Step 104 and Step 105 may be performed between Step 101 and Step 102. In certain embodiments, Step 104 and Step 105 may also be performed before Step 101. In certain embodiments, Step 104 and Step 105 may further be performed at the same time as Step 101.

In conclusion, certain embodiments of the present invention provide an OD method. The drive method includes: acquiring a display grayscale value of a current frame, where the display grayscale value is a grayscale value within a display grayscale range; obtaining a target grayscale value of the current frame according to the display grayscale value of the current frame, where the target grayscale value is a grayscale value within a target grayscale range, where a minimum target grayscale value of the target grayscale range is larger than the minimum display grayscale value of the display grayscale range, and/or the maximum target grayscale value of the target grayscale range is smaller than the maximum display grayscale value of the display grayscale range, and each of the display grayscale values within the display grayscale range corresponds one-by-one to one of the target grayscale values within the target grayscale range; and obtaining a system grayscale value of the current frame according to the target grayscale value of the current frame and a display grayscale value of a previous frame or according to the target grayscale value of the current frame and a system grayscale value of the previous frame, and outputting a corresponding gamma voltage according to the system grayscale value of the current frame. Because overdriving may be performed on the maximum target grayscale value and/or the minimum target grayscale value of the target grayscale range to effectively shorten the response time of the liquid crystals, a target grayscale value may be correspondingly obtained according to the display grayscale value based on the method as described in the embodiments, and then overdriving is performed on the target grayscale value, thereby effectively shortening the response time of the liquid crystals, so as to avoid crosstalk and enhance the display effect.

Figure 9:
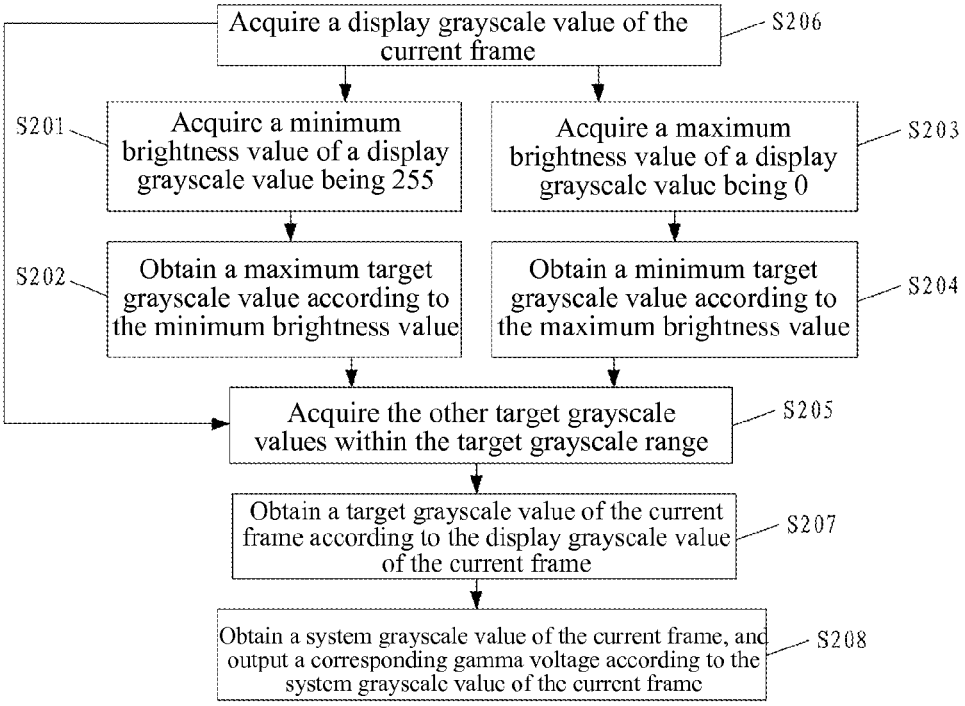
FIG. 9 is a schematic flow chart of an OD method according to one embodiment of the present invention.

An OD method according to a preferred embodiment of the present invention is hereinafter described in details. The embodiment uses an example where a display grayscale range is 0-255, a display grayscale value of a current frame is 250, a display grayscale value of a previous frame is 200, and a system grayscale value of the previous frame is 220. As shown in FIG. 9, the method includes the following steps:

Step 201: Acquire the minimum brightness value of a display grayscale value being 255 when the display grayscale value of the previous frame changes to the display grayscale value being 255.

Specifically, when the display grayscale value of a previous frame to the current frame is 0, and the display grayscale value of the current frame is 255, the brightness value corresponding to the grayscale value being 255 is 300 nit. When the display grayscale value of the previous frame to the current frame is 100, and the display grayscale value of the current frame is 255, the brightness value corresponding to the grayscale value being 255 is 310 nit. When the display grayscale value of the previous frame to the current frame is 200, and the display grayscale value of the current frame is 255, the brightness value corresponding to the grayscale value being 255 is 320 nit. Therefore, the minimum brightness value of the display grayscale value being 255 is 300 nit.

Step 202: Obtain the maximum target grayscale value by searching a mapping table according to the display grayscale value of the previous frame and the minimum brightness value of the display grayscale value being 255.

Specifically, by searching a mapping table, the corresponding maximum target grayscale value may be obtained as 248 when the minimum brightness value of the display grayscale value being 255 is 300 nit.

Step 203: Acquire the maximum brightness value of the display grayscale value being 0 when the display grayscale value of the previous frame changes to the display grayscale value being 0.

The specific process may be referred to Step 201, and is not repeated here. The minimum brightness value of the display grayscale value being 0 may be obtained as 1.0 nit.

Step 204: Obtain the minimum target grayscale value by searching a mapping table according to the display grayscale value of the previous frame and the maximum brightness value of the display grayscale value being 0.

The specific process may be referred to step 202, and is not repeated here. The minimum target grayscale value corresponding to the minimum brightness value of the display grayscale value being 0 may be obtained as 8.

Step 205: Acquire the other target grayscale values within the target grayscale range according to the maximum target grayscale value and the minimum target grayscale value of the target grayscale range and a corresponding relationship between a display grayscale value and a target grayscale value.

Specifically, the maximum target grayscale value is 248, the minimum target grayscale value is 8, the display grayscale range includes 256 grayscale values, and the corresponding relationship is specifically $$B = \frac{A * (R - P)}{255} + p,$$

where A is the display grayscale value of the current frame, B is the target grayscale value of the current frame, R is the maximum target grayscale value, and P is the minimum target grayscale value. The obtained 254 target grayscale values within the target grayscale range (the other target grayscale values within the target grayscale range) are the target grayscale values in the target grayscale range excluding the maximum target grayscale value and the minimum target grayscale value. For example, the target grayscale range may be: 8, 9, 10, 11, 11.75, 12.5, . . . , 244.25, 245, 246, and 248.

Step 206: Acquire the display grayscale value of the current frame.

Specifically, the example uses 250 as the display grayscale value of the current frame.

Step 207: Obtain a target grayscale value of the current frame according to the display grayscale value of the current frame.

Specifically, the display grayscale value of the current frame is 250, and by searching a first lookup table, the target grayscale value may be obtained as 243.25.

Step 208: Obtain a system grayscale value of the current frame according to the target grayscale value of the current frame and the system grayscale value of the previous frame, and output a corresponding gamma voltage according to the system grayscale value of the current frame.

Specifically, by searching a second lookup table according to the target grayscale value of the current frame, which is 243.25, and the system grayscale value of the previous frame, which is 220 as obtained in Step 207, the system grayscale value of the current frame may be obtained as 245. The output gamma voltage is a voltage corresponding to the grayscale value being 245.

A further embodiment of the present invention provides an apparatus corresponding to the foregoing OD method. It should be noted that, the functional units as described in the following apparatus may be used to execute the corresponding steps in the foregoing method. Therefore, the functional units of the apparatus in the following embodiment are not described in detail.

Figure 10:
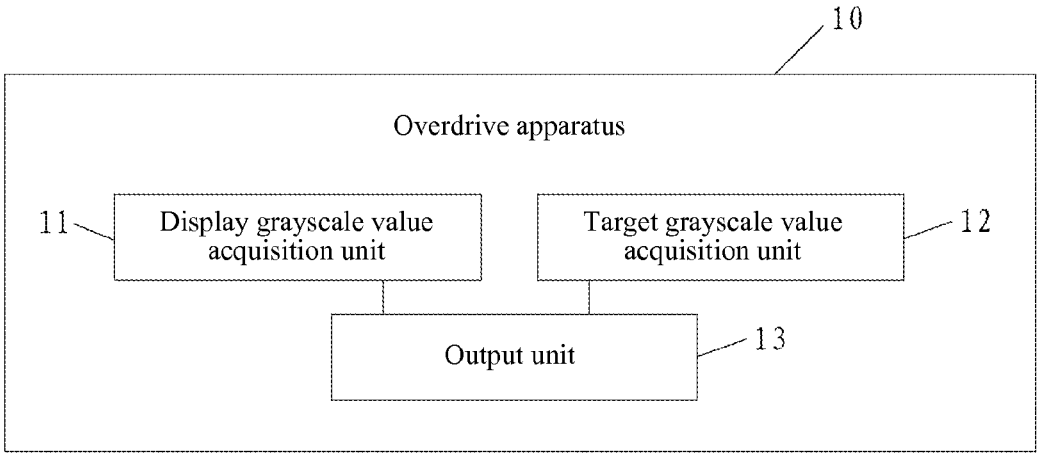
FIG. 10 is a schematic view of an OD apparatus according to one embodiment of the present invention.

As shown in FIG. 10, an embodiment of the present invention provides an OD apparatus 10, which includes:

a display grayscale value acquisition unit 11, configured to acquire a display grayscale value of a current frame, where the display grayscale value is a grayscale value within a display grayscale range;

a target grayscale value acquisition unit 12, configured to obtain a target grayscale value of the current frame according to the display grayscale value of the current frame acquired by the display grayscale value acquisition unit 11, wherein the target grayscale value is a grayscale value within a target grayscale range, wherein a minimum target grayscale value of the target grayscale value is larger than the minimum display grayscale value of the display grayscale value, and/or the maximum target grayscale value of the target grayscale value is smaller than the maximum display grayscale value of the display grayscale value, and each of the display grayscale values within the display grayscale range corresponds one-by-one to one of the target grayscale values within the target grayscale range; and an output unit 13, configured to obtain a system grayscale value of the current frame according to the target grayscale value of the current frame obtained by the target grayscale value acquisition unit 12 and a display grayscale value of a previous frame or according to the target grayscale value of the current frame obtained by the target grayscale value acquisition unit 12 and a system grayscale value of a previous frame, and to output a corresponding gamma voltage according to the system grayscale value of the current frame.

In certain embodiments, the OD apparatus may further include a storage unit, configured to store the display grayscale value of the previous frame or the system grayscale value of the previous frame.

Figure 11:
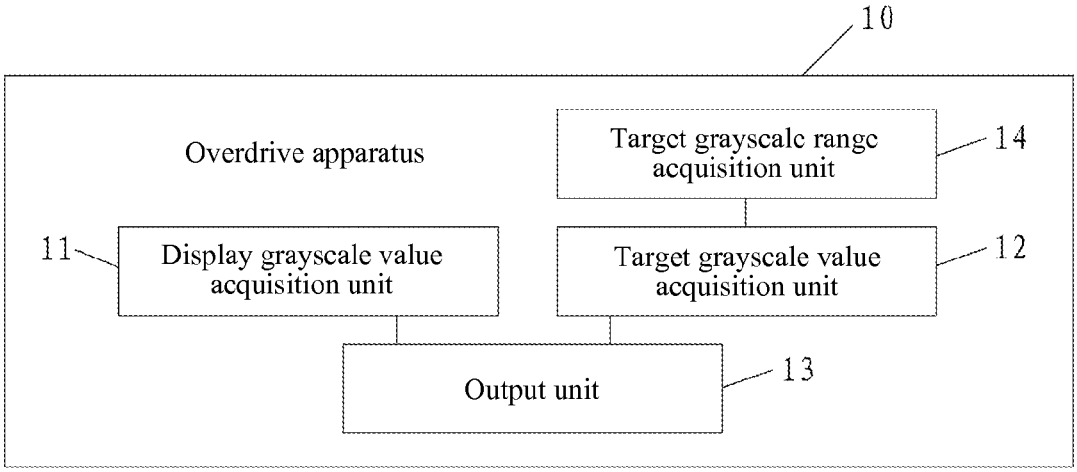
FIG. 11 is a schematic view of another OD apparatus according to one embodiment of the present invention.

In certain embodiments, as shown in FIG. 11, the OD apparatus 10 may further include: a target grayscale range acquisition unit 14, configured to acquire the target grayscale range.

Figure 12:
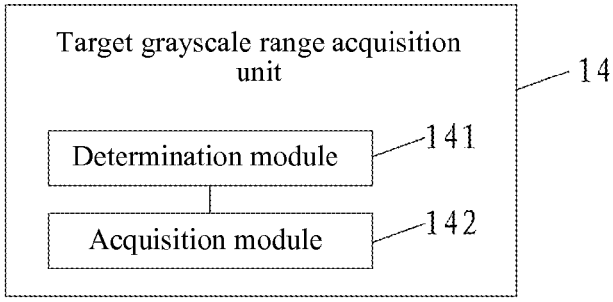
FIG. 12 is a schematic view of a target grayscale range acquisition unit according to one embodiment of the present invention.

In certain embodiments, as shown in FIG. 12, the target grayscale range acquisition unit 14 may include:

a determination module 141, configured to determine the maximum target grayscale value and the minimum target grayscale value of the target grayscale range according to the maximum display grayscale value and the minimum display grayscale value of the display grayscale range; and an acquisition module 142, configured to acquire the other target grayscale values within the target grayscale range according to the maximum target grayscale value and the minimum target grayscale value of the target grayscale range and a corresponding relationship between the display grayscale value and the target grayscale value.

Figure 13:
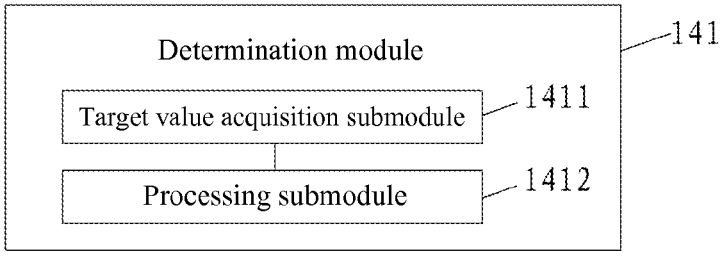
FIG. 13 is a schematic view of a determination module according to one embodiment of the present invention.

In certain embodiments, as shown in FIG. 13, the determination module 141 may include:

a target value acquisition submodule 1411, configured to determine a first target brightness value corresponding to the minimum display grayscale value when a display grayscale value of a random frame prior to the current frame changes to the minimum display grayscale value; and a processing submodule 1412, configured to obtain the minimum target grayscale value according to the first target brightness value.

In certain embodiments, the target value acquisition submodule 1411 is further configured to determine a second target brightness value corresponding to the maximum display grayscale value when a display grayscale value of a random frame prior to the current frame changes to the maximum display grayscale value; and the processing submodule 1412 is further configured to obtain the maximum target grayscale value according to the second target brightness value.

In certain embodiments, the processing submodule 1412 is specifically configured to obtain the minimum target grayscale value by searching a mapping table according to the display grayscale value of the random frame prior to the current frame and the first target brightness value, and to obtain the maximum target grayscale value by searching the mapping table according to the display grayscale value of the random frame prior to the current frame and the second target brightness value.

In certain embodiments, the target grayscale range acquisition unit 12 is specifically configured to obtain the target grayscale value of the current frame through linear compensation or through mapping compensation with a first lookup table according to the display grayscale value of the current frame acquired by the display grayscale value acquisition unit.

In certain embodiments, the output unit 13 is specifically configured to obtain the system grayscale value of the current frame by querying a second lookup table according to the target grayscale value of the current frame obtained by the target grayscale value acquisition unit 12 and the display grayscale value of the previous frame or according to the target grayscale value of the current frame and the system grayscale value of the previous frame.

A specific embodiment of the foregoing OD apparatus is hereinafter described.

The target value acquisition submodule 1411 acquires the minimum brightness value of the display grayscale value being 255 when the display grayscale value of the previous frame changes to the display grayscale value being 255. Then the target value acquisition submodule 1411 obtains the maximum target grayscale value being 248 by searching a mapping table according to the minimum brightness value of the display grayscale value being 255. Then the target value acquisition submodule 1411 acquires the maximum brightness value of the display grayscale value being 0 when the display grayscale value of the previous frame changes to the display grayscale value being 0, and obtains the minimum target grayscale value being 8 by searching a mapping table according to the maximum brightness value of the display grayscale value being 0.

The processing submodule 1412 acquires the target grayscale range according to the maximum target grayscale value and the minimum target grayscale value of the target grayscale range acquired by the target value acquisition submodule 1411 and the corresponding relationship between a display grayscale value and a target grayscale value.

Specifically, the maximum target grayscale value is 248, the minimum target grayscale value is 8, the display grayscale range includes 256 grayscale values, and the corresponding relationship is $$B = \frac{A*(R-P)}{255} + p,$$

where A is the display grayscale value of the current frame, B is the target grayscale value of the current frame, R is the maximum target grayscale value, and P is the minimum target grayscale value. The obtained 254 target grayscale values within the target grayscale range (the other target grayscale values within the target grayscale range) are target grayscale values within the target grayscale range excluding the maximum target grayscale value and the minimum target grayscale value. For example, the target grayscale range may be: 8, 9, 10, 11, 11.75, 12.5, . . . , 244.25, 245, 246, and 248.

The display grayscale value acquisition unit 11 acquires the display grayscale value of the current frame, for example, the display grayscale value of the current frame being 250.

The target grayscale value acquisition unit 12 obtains the target grayscale value of the current frame according to the display grayscale value of the current frame acquired by the display grayscale value acquisition unit 11. Specifically, by searching a first lookup table according to the display grayscale value of the current frame, the target grayscale value of the current frame may be obtained as 243.25.

The output unit 13 obtains the system grayscale value of the current frame according to the target grayscale value of the current frame acquired by the target grayscale value acquisition unit 12 and the system grayscale value of the previous frame, and outputs the corresponding gamma voltage according to the system grayscale value. Specifically, by searching a second lookup table according to the target grayscale value of the current frame, which is 243.25 acquired by the target grayscale value acquisition unit 12, and the system grayscale value of the previous frame, which is 220, the system grayscale value of the current frame may be obtained as 245, and the gamma voltage output correspondingly is a voltage corresponding to the grayscale value being 245. The system grayscale value of the previous frame may be acquired from the storage unit of the OD apparatus.

In the OD apparatus according to certain embodiments of the present invention, the overdrive apparatus includes a target grayscale value acquisition unit, configured to obtain a target grayscale value of the current frame according to the display grayscale value of the current frame, where the target grayscale value is a grayscale value within a target grayscale range having a minimum target grayscale value and a maximum target grayscale value. The minimum target grayscale value is larger than the minimum display grayscale value, and/or the maximum target grayscale value is smaller than the maximum display grayscale value. Thus, even if a display grayscale value is large or small, when overdriving is performed on a target grayscale value, a response time of the liquid crystals may be effectively shortened, so as to reduce crosstalk and enhance the display effect.

It should be noted that in the OD apparatus according to the embodiments of the present invention, the units and modules included are manually classified by function. In a practical operational process, one unit or module in the drive apparatus may be an accumulated set of the functions of a plurality of units or modules above. The embodiments as described above are provided only for the purpose of detailed illustration for the present invention.

One embodiment of the present invention provides a display device, which includes a random OD apparatus according to certain embodiments of the present invention. The display device may be any products or parts having a display function, such as a liquid crystal display, a liquid crystal television, a digital camera, a mobile phone or a tablet computer.

Through the above description of the implementation, it should be clear to one of ordinary skill in the art that the present invention may be accomplished through software implementation in addition to necessary universal hardware, or may be implemented through hardware components. However, the former is the preferred implementation in most cases. Based on such understanding, the technical solutions of the present invention may be embodied in the form of a software product executable by a processor or a computer. The computer software product may be stored in a readable storage media such as a floppy disk, a hard disk or an optical disc, and contains several instructions adapted to instruct computer equipments (for example, a personal computer, a server, or network equipment) to perform the method according to the embodiments of the present invention.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. An overdrive (OD) method, comprising:

acquiring a display grayscale value of a current frame, wherein the display grayscale value is a grayscale value within a display grayscale range;

obtaining a target grayscale value of the current frame according to the display grayscale value of the current frame, wherein the target grayscale value is a grayscale value within a target grayscale range, wherein a minimum target grayscale value of the target grayscale range is larger than a minimum display grayscale value of the display grayscale range, and/or a maximum target grayscale value of the target grayscale range is smaller than a maximum display grayscale value of the display grayscale range, and each of the display grayscale values within the display grayscale range corresponds one-by-one to one of the target grayscale values within the target grayscale range; and obtaining a system grayscale value of the current frame according to the target grayscale value of the current frame and a display grayscale value of a previous frame or according to the target grayscale value of the current frame and a system grayscale value of the previous frame, and outputting a corresponding gamma voltage according to the system grayscale value of the current frame.

2. The OD method according to claim 1, prior to the step of obtaining a target grayscale value of the current frame according to the display grayscale value of the current frame, further comprising:

determining the maximum target grayscale value and the minimum target grayscale value of the target grayscale range according to the maximum display grayscale value and the minimum display grayscale value of the display grayscale range; and acquiring the other target grayscale values within the target grayscale range according to the maximum target grayscale value and the minimum target grayscale value of the target grayscale range and a corresponding relationship between the display grayscale value and the target grayscale value.

3. The OD method according to claim 2, wherein the corresponding relationship between the display grayscale value and the target grayscale value is $$B = \frac{A*(R-P)}{255} + p,$$

wherein A is the display grayscale value of the current frame, B is the target grayscale value of the current frame, R is the maximum target grayscale value, and P is the minimum target grayscale value.

4. The OD method according to claim 2, wherein the step of determining the maximum target grayscale value and the minimum target grayscale value of the target grayscale range according to the maximum display grayscale value and the minimum display grayscale value of the display grayscale range comprises:

determining a first target brightness value corresponding to the minimum display grayscale value when a display grayscale value of a random frame prior to the current frame changes to the minimum display grayscale value; and obtaining the minimum target grayscale value according to the first target brightness value.

5. The OD method according to claim 4, wherein the first target brightness value is a maximum brightness value corresponding to the minimum display grayscale value.

6. The OD method according to claim 2, wherein the step of determining the maximum target grayscale value and the minimum target grayscale value of the target grayscale range according to the maximum target grayscale value and the minimum target grayscale value of the display grayscale range comprises:

determining a second target brightness value corresponding to the maximum display grayscale value when a display grayscale value of the random frame prior to the current frame changes to the maximum display grayscale value; and obtaining the maximum target grayscale value according to the second target brightness value.

7. The OD method according to claim 6, wherein the second target brightness value is a minimum brightness value corresponding to the maximum display grayscale value.

8. The OD method according to claim 4, wherein the random frame prior to the current frame is the previous frame of the current frame.

9. The OD method according to claim 6, wherein the random frame prior to the current frame is the previous frame of the current frame.

10. The OD method according to claim 4, wherein the step of obtaining the minimum target grayscale value according to the first target brightness value comprises:

obtaining the minimum target grayscale value by searching a mapping table according to the display grayscale value of the random frame prior to the current frame and the first target brightness value.

11. The OD method according to claim 6, wherein the step of obtaining the maximum target grayscale value according to the second target brightness value comprises:

obtaining the maximum target grayscale value by searching a mapping table according to the display grayscale value of the random frame prior to the current frame and the second target brightness value.

12. The OD method according to claim 1, wherein the step of obtaining a target grayscale value of the current frame according to the display grayscale value of the current frame comprises:

obtaining the target grayscale value of the current frame through linear compensation or through mapping compensation with a first lookup table according to the display grayscale value of the current frame.

13. The OD method according to claim 1, wherein the step of obtaining a system grayscale value of the current frame according to the target grayscale value of the current frame and a display grayscale value of a previous frame or according to the target grayscale value of the current frame and a system grayscale value of a previous frame comprises:

obtaining the system grayscale value of the current frame by querying a second lookup table according to the target grayscale value of the current frame and the display grayscale value of the previous frame or according to the target grayscale value of the current frame and the system grayscale value of the previous frame.

14. The OD method according to claim 1, wherein the minimum target grayscale value is 8, and the maximum target grayscale value is 248.

15. An overdrive (OD) apparatus, comprising:

a display grayscale value acquisition unit executable by a processor, configured to acquire a display grayscale value of a current frame, wherein the display grayscale value is a grayscale value within a display grayscale range;

a target grayscale value acquisition unit executable by the processor, configured to obtain a target grayscale value of the current frame according to the display grayscale value of the current frame acquired by the display grayscale value acquisition unit, wherein the target grayscale value is a grayscale value within a target grayscale range, wherein a minimum target grayscale value of the target grayscale range is larger than a minimum display grayscale value of the display grayscale range, and/or a maximum target grayscale value of the target grayscale range is smaller than a maximum display grayscale value of the display grayscale range, and each of the display grayscale values within the display grayscale range corresponds one-by-one to one of the target grayscale values within the target grayscale range; and an output unit executable by the processor, configured to obtain a system grayscale value of the current frame according to the target grayscale value of the current frame obtained by the target grayscale value acquisition unit and a display grayscale value of a previous frame or according to the target grayscale value of the current frame obtained by the target grayscale value acquisition unit and a system grayscale value of a previous frame, and to output a corresponding gamma voltage according to the system grayscale value of the current frame.

16. The OD apparatus according to claim 15, further comprising:

a target grayscale range acquisition unit, comprising:

a determination module, configured to determine the maximum target grayscale value and the minimum target grayscale value of the target grayscale range according to the maximum display grayscale value and the minimum display grayscale value of the display grayscale range; and an acquisition module, configured to acquire other target grayscale values within the target grayscale range according to the maximum target grayscale value and the minimum target grayscale value of the target grayscale range and a corresponding relationship between the display grayscale value and the target grayscale value.

17. The OD apparatus according to claim 16, wherein the determination module comprises:

a target value acquisition submodule, configured to determine a first target brightness value corresponding to the minimum display grayscale value when a display grayscale value of a random frame prior to the current frame changes to the minimum display grayscale value; and a processing submodule, configured to obtain the minimum target grayscale value according to the first target brightness value.

18. The OD apparatus according to claim 17, wherein the target value acquisition submodule is further configured to determine a second target brightness value corresponding to the maximum display grayscale value when a display grayscale value of a random frame prior to the current frame changes to the maximum display grayscale value; and wherein the processing submodule is further configured to obtain the maximum target grayscale value according to the second target brightness value.

19. The OD apparatus according to claim 18, wherein the processing submodule is configured to obtain the minimum target grayscale value by searching a mapping table according to the display grayscale value of the random frame prior to the current frame and the first target brightness value, and to obtain the maximum target grayscale value by searching the mapping table according to the display grayscale value of the random frame prior to the current frame and the second target brightness value.

20. The OD apparatus according to claim 17, wherein the processing submodule is configured to obtain the minimum target grayscale value by searching a mapping table according to the display grayscale value of the random frame prior to the current frame and the first target brightness value.

21. The OD apparatus according to claim 16, wherein the target grayscale range acquisition unit is configured to obtain the target grayscale value of the current frame through linear compensation or through mapping compensation with a first lookup table according to the display grayscale value of the current frame acquired by the display grayscale value acquisition unit.

22. The OD apparatus according to claim 15, wherein the output unit is configured to obtain the system grayscale value of the current frame by querying a second lookup table according to the target grayscale value of the current frame obtained by the target grayscale value acquisition unit and the display grayscale value of the previous frame or according to the target grayscale value of the current frame obtained by the target grayscale value acquisition unit and the system grayscale value of the previous frame.

23. A display device, comprising the OD apparatus according to claim 15.

* * * * *